US007075495B2

(12) United States Patent
Jung et al.

(10) Patent No.: US 7,075,495 B2
(45) Date of Patent: Jul. 11, 2006

(54) OFFSET HYBRID ANTENNA USING FOCUSER

(75) Inventors: Young-Bae Jung, Daejon (KR); Soon-Young Eom, Daejon (KR); Jae-Seung Yun, Daejon (KR); Seong-Ho Son, Busan (KR); Soon-Ik Jeon, Daejon (KR); Chang-Joo Kim, Daejon (KR)

(73) Assignee: Electronics and Telecommunications Research Institute (KR)

( * ) Notice: Subject to any disclaimer, the term of this patent is extended or adjusted under 35 U.S.C. 154(b) by 49 days.

(21) Appl. No.: 10/981,104

(22) Filed: Nov. 3, 2004

(65) Prior Publication Data

US 2005/0140558 A1 Jun. 30, 2005

(30) Foreign Application Priority Data

Dec. 26, 2003 (KR) ..... 10-2003-0097844

(51) Int. Cl.
*H01Q 19/14* (2006.01)

(52) U.S. Cl. ..... 343/779; 343/781 R

(58) Field of Classification Search ..... 343/779, 343/781 R, 781 P, 786; H01Q 19/14
See application file for complete search history.

(56) References Cited

U.S. PATENT DOCUMENTS 3,757,326 A * 9/1973 White ..... 342/81
5,017,929 A * 5/1991 Tsuda ..... 342/427
5,202,700 A 4/1993 Miller
5,949,370 A 9/1999 Smith et al.

FOREIGN PATENT DOCUMENTS

JP 06-268438 9/1994
JP 2003-078329 3/2003

OTHER PUBLICATIONS

A.G. Roederer et al., "Semi-Active Hybrid Antennas For Satellites", 1993 The Institution of Electrical Engineers; IEE, (12 pp).

* cited by examiner

*Primary Examiner*—Hoanganh Le
(74) *Attorney, Agent, or Firm*—Blakely, Sokoloff, Taylor & Zafman

(57) ABSTRACT

A Ka-band offset hybrid antenna having a shaped focuser is disclosed. The Ka-band offset hybrid antenna having a shaped focuser, including: a shaped focuser for reflecting a received plane wave to focus an energy of the received plane wave on an offset focal line and reflecting a transmitting signal; and an active feed array module for receiving the reflected received plane wave from the shaped focuser and radiating the transmitting signal to the shaped focuser antenna, wherein the active feed array module including a feed horn array antenna having a plurality of single horns and an active channel block (ACB) having multi-active channels for changing a direction angle of transceiving beam.

9 Claims, 15 Drawing Sheets

OFFSET HYBRID ANTENNA USING FOCUSER

FIELD OF THE INVENTION

The present invention relates to an offset hybrid antenna; and, more particularly, to an offset hybrid antenna using a shaped focuser for a Ka band satellite communication system.

DESCRIPTION OF RELATED ARTS

Generally, an antenna structure is determined by considering a performance, a price and implementation environment. Conventionally, a reflector antenna using a single horn antenna as a feed antenna has been widely used for a satellite communication antenna system providing a fixed antenna beam. The reflector antenna is implemented with a mechanical positioning device for a mobile environment. The reflector antenna is mainly used as small sized antenna which has comparatively wide antenna beam-width. Since the reflector antenna with the mechanical positioning device has a slower tracing speed, the reflector antenna is commonly used for slower moving objects such as a ship.

The reflector antenna has several advantages such as simple structure and low manufacturing price. However, the reflector antenna with the mechanical positioning device may degrade a performance caused by a target trace error. Also, the reflector antenna may generate a tracing loss caused by narrow beam-width of the reflector antenna thus the reflector antenna cannot be used for a high gain antenna mounted at a moving object.

In a mean time, a phase array antenna system can trace a target in high speed by using an electric beam and thus the phase array antenna system has been widely used for a military radar system. However, the phase array antenna system requires a multi-band, a high gain and a wide beam scan sector. Therefore, there are many limitations of manufacturing, price and integration for satisfying the requirements.

In a mobile satellite communication environment, an effective antenna structure has been demanded for developing a low priced antenna having high gain antenna characteristics. Therefore, it demands an antenna system having high speed electric beam tracing characteristic of the phase array antenna and high gain characteristic of the reflector antenna as an antenna structure having limited electric beam scanning range and high gain characteristic.

SUMMARY OF THE INVENTION

It is, therefore, one object of the present invention to provide a Ka-band offset hybrid antenna using a shaped focuser for optimizing a beam pattern and reducing a blocking loss by forming an aperture of the shaped focuser adaptable to one-dimensional beam scanning and offsetting a feed array.

It is another object of the present invention to provide a Ka band offset hybrid antenna using a shaped focuser for being mounted at a moving object having a positioning system that coarsely traces a target by using a mechanical positioning system and finely traces a target by electric positioning system.

It is still anther object of the present invention to provide a Ka band offset hybrid antenna using a shaped focuser for an antenna system mounted with a fixed object, which traces target in a small area.

It is further still another object of the present invention to provide a Ka band offset hybrid antenna using a focuser for developing a small sized and low priced antenna system having limited one dimensional beam scanning in multi-band.

It is further still another object of the present invention to provide an offset hybrid antenna using a shaped focuser, wherein the shaped focuser is shaped to have an appearance of lower aperture and one-dimensional beam scanning and has an offset feed array for reducing a blocking loss and optimizing a beam pattern.

It is further still another object of the present invention to provide an offset hybrid antenna using a shaped focuser having a feed array as linear active phase and a curvilinear rim structure as an edge of a aperture.

It is further still another object of the present invention to provide a Ka band offset hybrid antenna using a shaped focuser being mounted at a moving object for transmitting multimedia data to a satellite on a geostationary orbit.

Therefore, it is an object of the present invention to provide a Ka-band offset hybrid antenna, including: a shaped focuser for reflecting a received plane wave to focus an energy of the received plane wave on an offset focal line and reflecting a transmitting signal; and an active feed array module for receiving the reflected received plane wave from the shaped focuser and radiating the transmitting signal to the shaped focuser antenna, wherein the active feed array module including a feed horn array antenna having a plurality of single horns and an active channel block (ACB) having multi-active channels for changing a direction angle of transceiving beam.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, a Ka band offset hybrid antenna using a shaped focuser in accordance with a preferred embodiment of the present invention will be described in detail with reference to the accompanying drawings.

Figure 1:
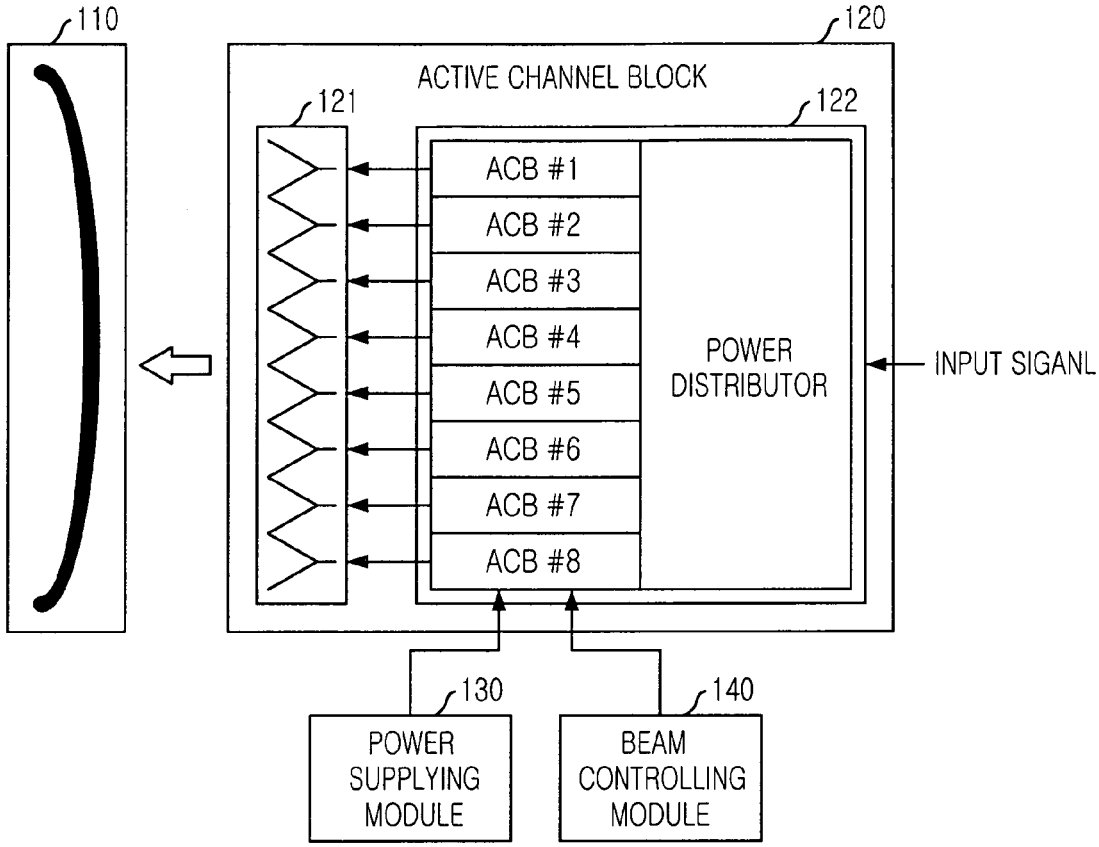
FIG. 1 is a diagram showing a Ka band offset hybrid antenna using a shaped focuser in accordance with a preferred embodiment of the present invention.

FIG. 1 is a diagram showing a Ka band offset hybrid antenna using a shaped focuser in accordance with a preferred embodiment of the present invention.

As shown in FIG. 1, the Ka band offset hybrid antenna 100 includes a shaped focuser 110 for reflecting a received plane wave to focus an energy of the received plane wave on an offset focal line and reflecting a transmitting signal; an active feed array module 120 for receiving the reflected received plane wave from the shaped focuser 110 and radiating the transmitting signal to the shaped focuser antenna 110, a power supplying module 130 for supplying direct current of electric power to the active feed array module 120 and a beam controlling module 140 for controlling a beam direction of the active feed array module 120.

The active feed array module 120 further includes a feed horn array antenna 121 having a plurality of single horns and an active channel block (ACB) 122 having multi-active channels. In the preferred embodiment of the present invention shown in FIG. 1, 8 single horn antennas and 8 active channels are includes in the active feed array module 120. The 8 single horn antennas and 8 active channels are connected each other in one-to-one manner.

Each of the 8 single horn antennas outputs a radio frequency (RF) signal having unique phase and intensity.

The RF signals from 8 single horn antennas are inputted corresponding single horn antennas and the feed horn array antenna radiates 121 the inputted RF signals to the shaped focuser 110. The shaped focuser 110 reflects the RF signal radiated from the feed horn array antenna 121 in a desired direction.

Figure 2:
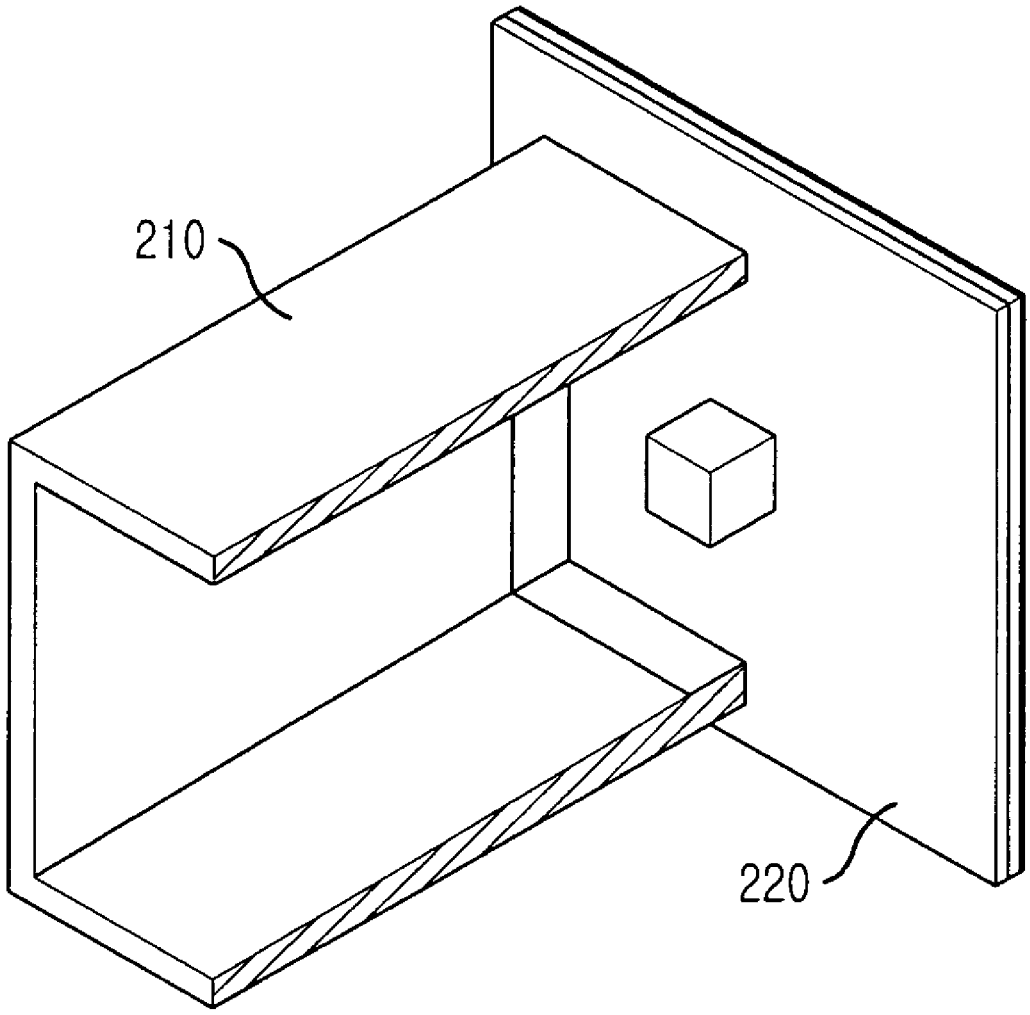
FIG. 2 is a diagram illustrating a single horn in a feed horn array antenna 121 in FIG. 1.

FIG. 2 is a diagram illustrating a single horn in a feed horn array antenna 121 in FIG. 1.

As mentioned above, the feed horn array antenna 121 in FIG. 1 includes 8 single horns. Each of 8 shingle horns of the feed horn array antenna 121 is illustrated in FIG. 2.

As shown in FIG. 2, the single horn of the feed horn array antenna 121 includes a horn 210 and a polarizing flatbed radiation element 220.

The polarizing flatbed radiation element 220 feeds an electric power to the horn 210 and also induces a polarized wave at the same time. Accordingly, additional polarizer is not required the feed horn array antenna 121 in the present invention. Therefore, the feed horn array antenna 121 has simpler structure and smaller size comparing to a conventional horn array antenna.

In the preferred embodiment of the present invention, the single horn has a perfect square waveguide aperture having a size of $0.94\lambda \times 0.94\lambda$ in order to provide higher radiation efficiency for Ka-band. Accordingly, a gap between feed array is $0.94\lambda$ expressed by wavelength.

Figure 3:
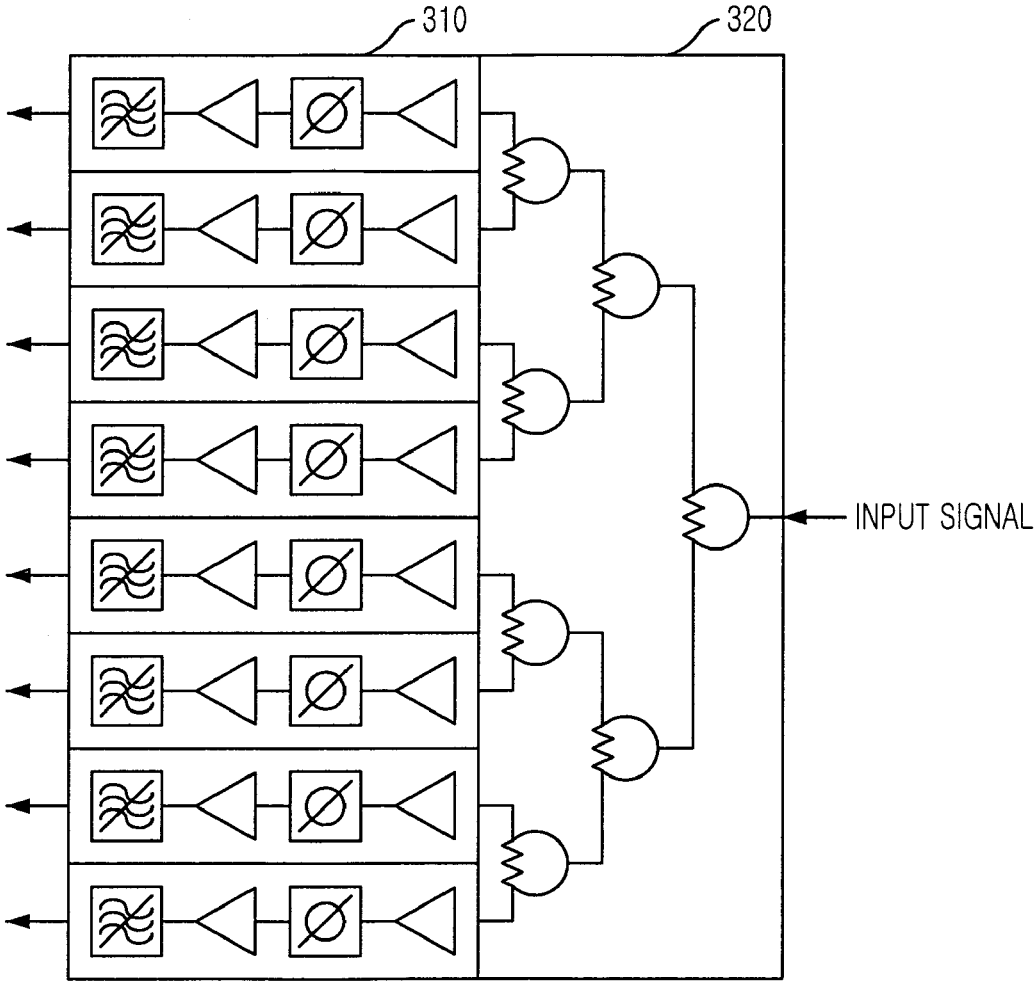
FIG. 3 is a diagram showing an active channel block 122 in an active feed array module 120 in FIG. 1.

FIG. 3 is a diagram showing an active channel block 122 in an active feed array module 120 in FIG. 1.

As shown in FIG. 3, the active channel block 122 includes 8 active channels 310 and a 1:8 power divider 320.

Each of active channels 310 includes a 5-bit digital phase shifter, low noise amplifier, a high power amplifier and a micro-strip type of transmitting-band pass filter.

The active channels 310 controls to steer a beam direction of the active feed array module according to a control signal from the beam controlling module 140 and accordingly, a beam direction of the offset hybrid antenna is controlled.

Figure 4A:
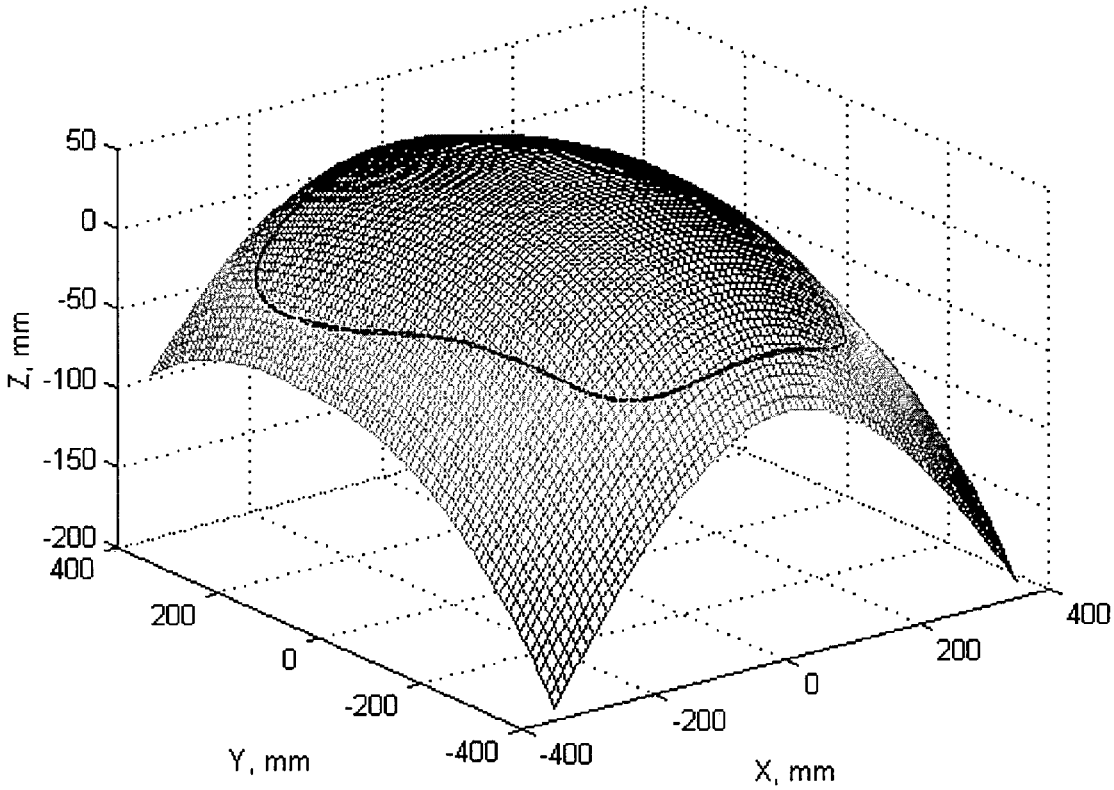
FIGS. 4A and 4B show a shaped focuser of a Ka-band offset hybrid antenna in accordance with a preferred embodiment of the present invention.
Figure 4B:
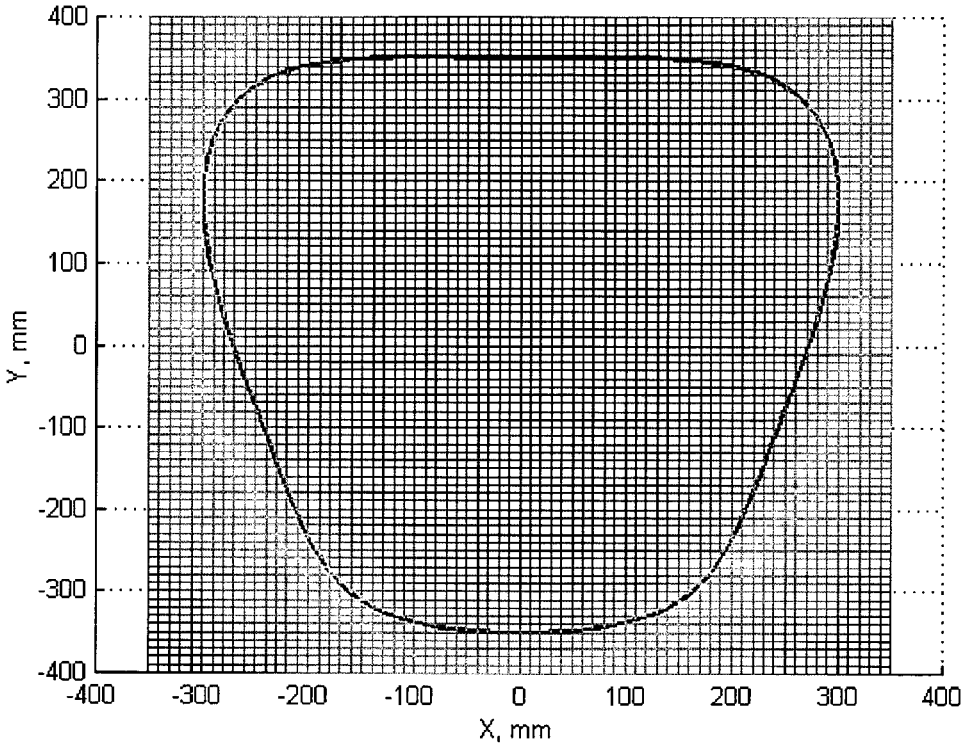

FIGS. 4A and 4B show a shaped focuser of a Ka-band offset hybrid antenna in accordance with a preferred embodiment of the present invention.

As shown in FIGS. 4A and 4B, the shaped focuser 110 is designed for optimizing to beam-scan a signal radiated from the active feed array module 122 in ±3° of wave angle.

Therefore, edge of the shaped focuser 110 is a curvilinear rim and an aperture of the shaped focuser 110 is lower comparing to conventional focuser.

Figure 5A:
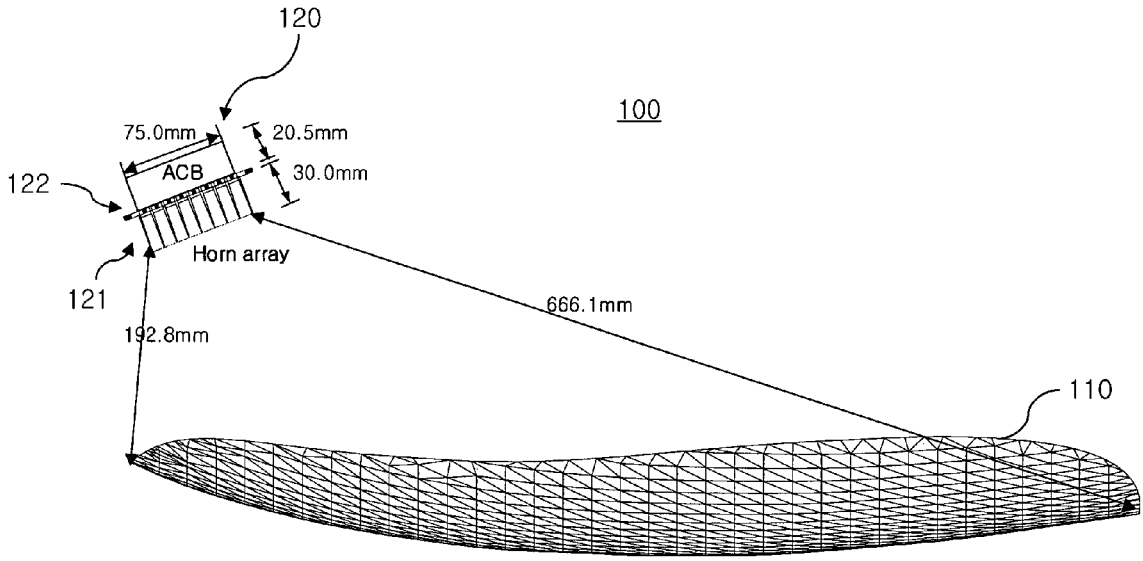
FIG. 5A is a side elevation view of a ka-band offset hybrid antenna.
Figure 5B:
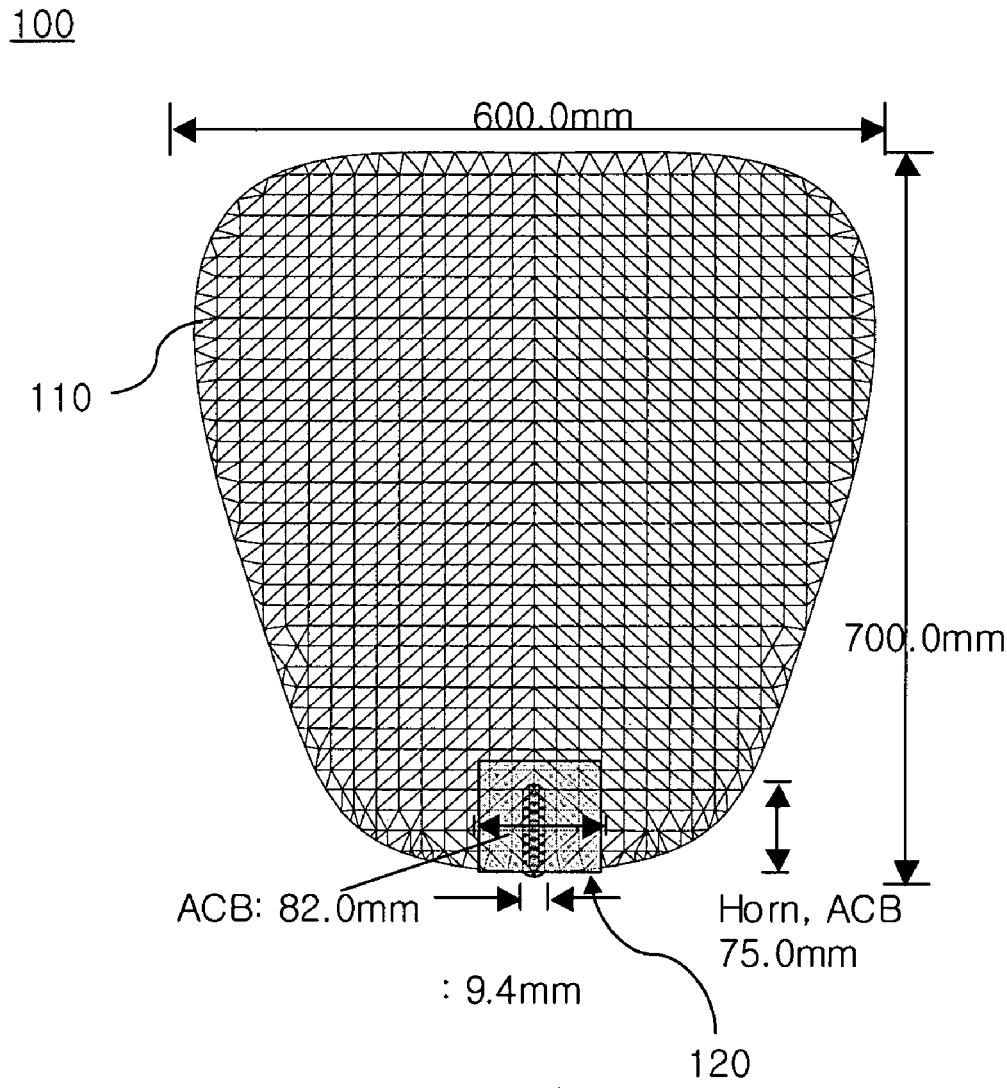
FIG. 5B is a top view of a ka-band offset hybrid antenna in accordance with a preferred embodiment of the present invention.

FIG. 5A is a side elevation view of a ka-band offset hybrid antenna and FIG. 5B is a top view of a ka-band offset hybrid antenna in accordance with a preferred embodiment of the present invention.

The active feed array module 120 including the feed horn array antenna 121 and the active channel block 122 is positioned by offsetting from the shaped focuser 110. A position of the active feed array module 120 is decided by considering a size and a curvature of the shaped focuser 110 for providing optimal performance of the feed horn array antenna 121. Furthermore, by offsetting the active feed array module 120 from the shaped focuser 110, a blocking loss can be eliminated.

In the preferred embodiment of the present invention, the shaped focuser 120 has a size of 600 mm×700 mm and the active feed array module 120 is offset from one side of the shaped focuser 110 within 192.8 mm and from another side of the shaped focuser 110 within 666.1 mm.

Figure 6:
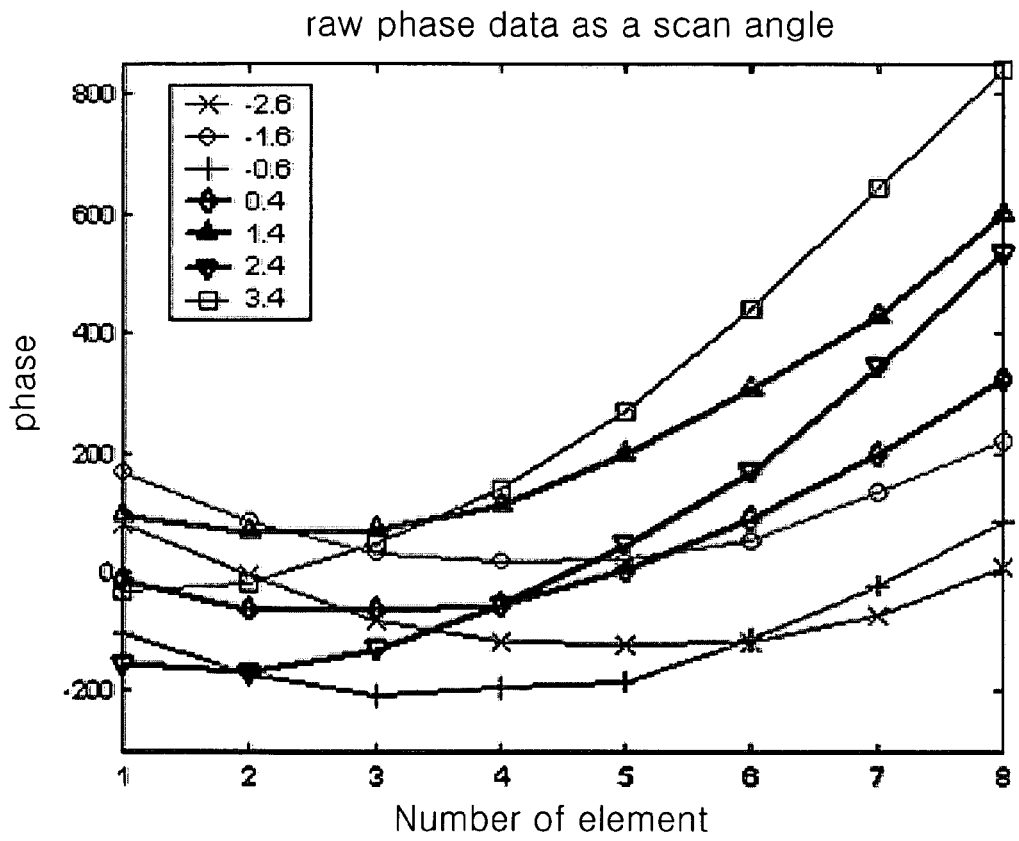
FIG. 6 is a graph showing phase data of 8 active channels of a Ka band offset hybrid antenna having a shaped focuser in accordance with a preferred embodiment of the present invention.

FIG. 6 is a graph showing phase data of 8 active channels of a Ka band offset hybrid antenna having a shaped focuser in accordance with a preferred embodiment of the present invention.

As shown, a plurality of curves shows phase data based on 8 active channels generated from for controlling beam direction. The phase data generated from the ka band offset hybrid antenna have non-linear values which are distinguishable from conventional phase array antenna.

FIGS. 7A to 7F are graphs showing antenna pattern characteristic based on beam-scan angle of a Ka band offset hybrid antenna in accordance with a preferred embodiment of the present invention.

Figure 7A:
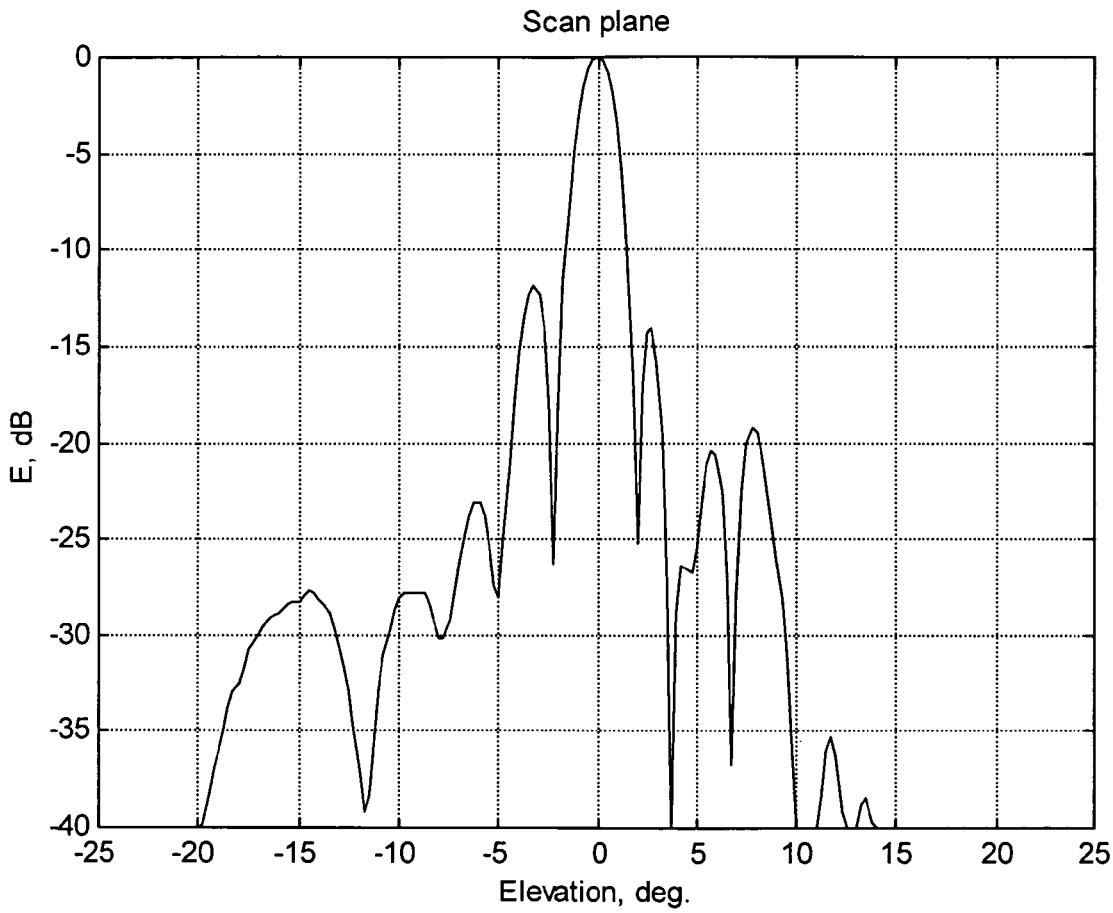
FIGS. 7A to 7F are graphs showing antenna pattern characteristic based on beam-scan angle of a Ka band offset hybrid antenna in accordance with a preferred embodiment of the present invention.
Figure 7B:
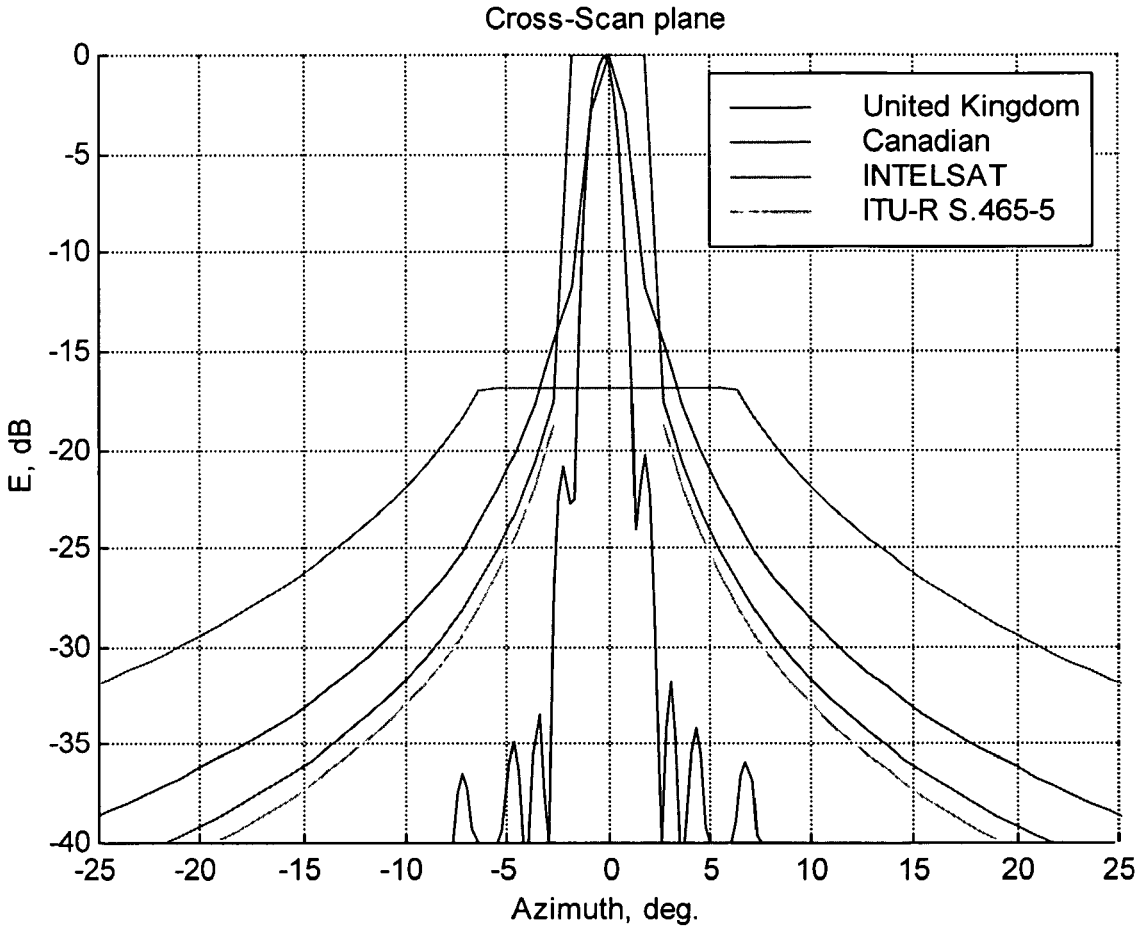
Figure 7C:
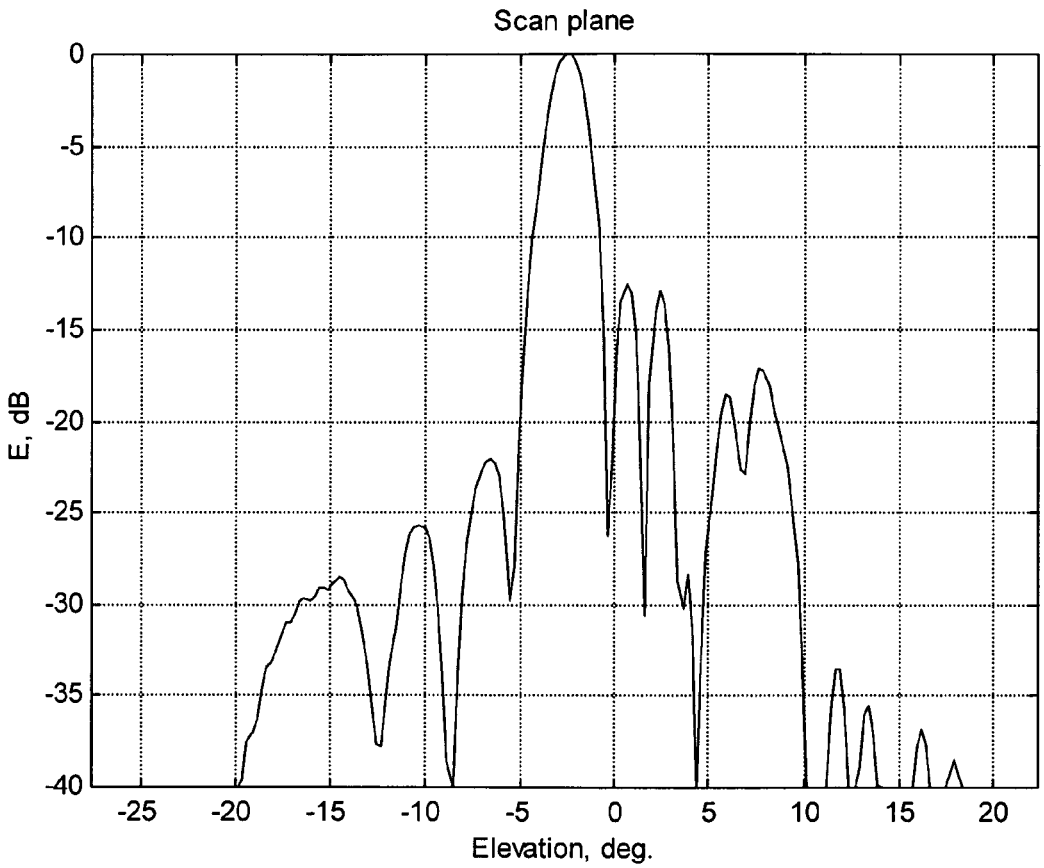
Figure 7D:
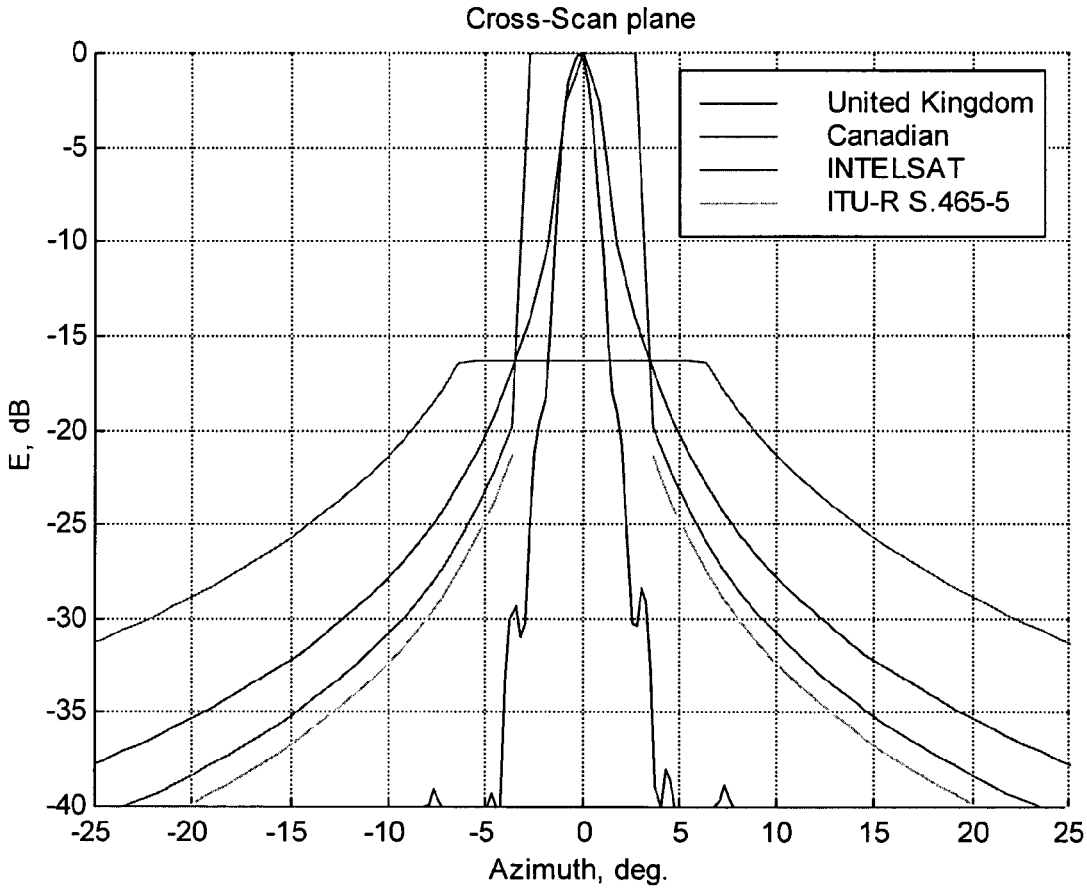
Figure 7E:
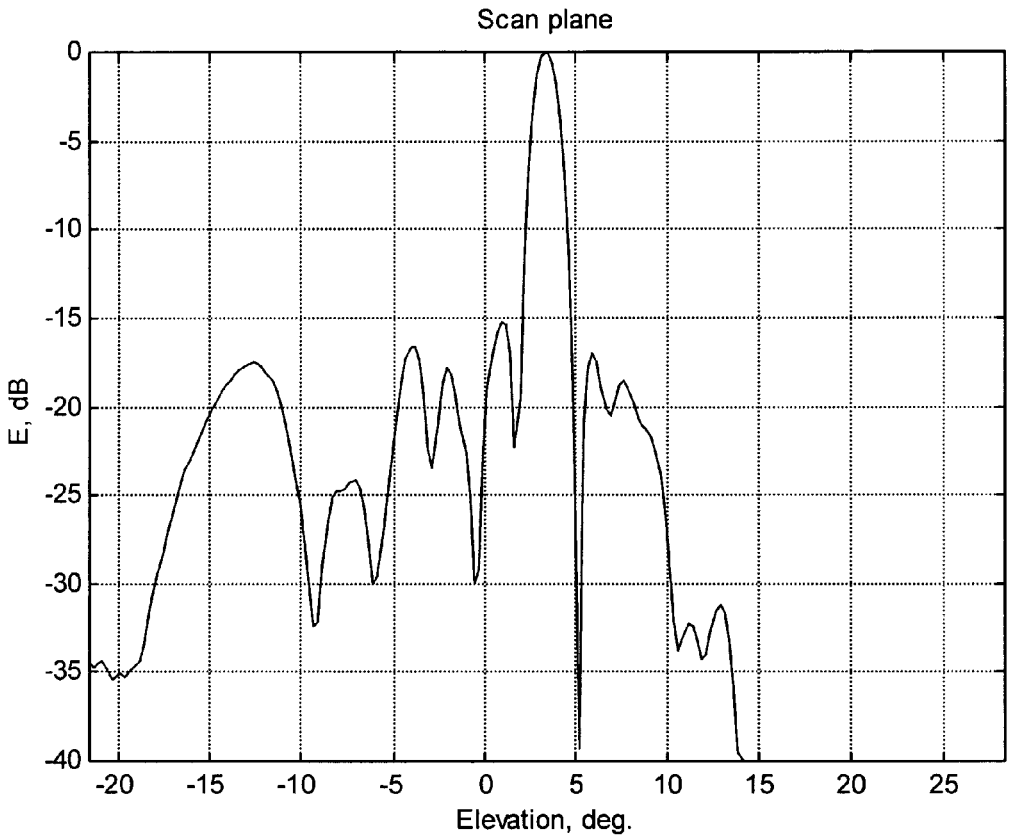
Figure 7F:
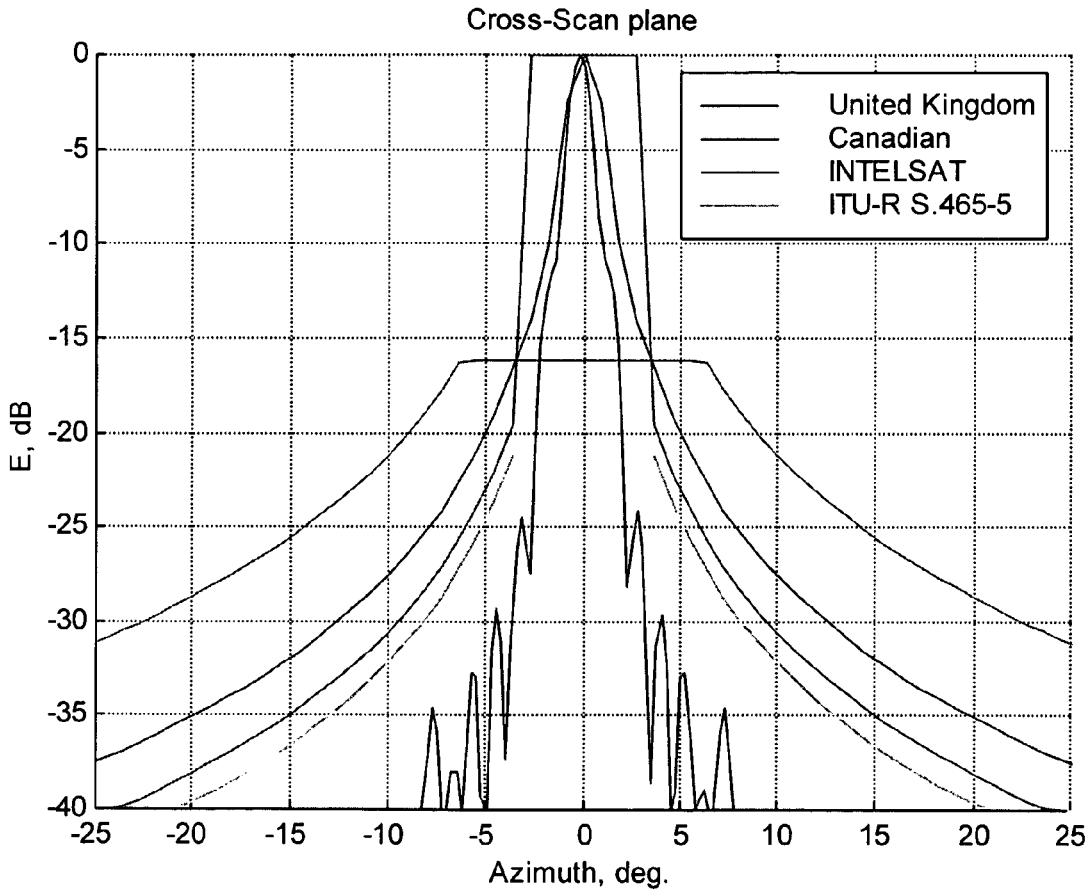

FIGS. 7A and 7B show antenna pattern characteristics of the present invention when a beam scan angle is 0° and when an azimuth is 0°, respectively. Also, FIGS. 7C and 7D show antenna pattern characteristics when a beam scan angle is −2.6° and when an azimuth is 2.6°, respectively. Furthermore, FIGS. 7E and 7F show antenna pattern characteristics when a beam scan angle is 3.4° and when an azimuth is 3.4°, respectively.

Graphs in FIGS. 7A to 7D shows that the ka band offset hybrid antenna of the present invention, which has a structure shown in FIGS. 5A, 5B and phase data of active channels shown in FIG. 6, has a beam pattern characteristic as more than −12 dBc of a side lobe level in radiation angle and beam patterns in radiation angle satisfies ITU-R.465-5 beam pattern regulation.

Figure 8:
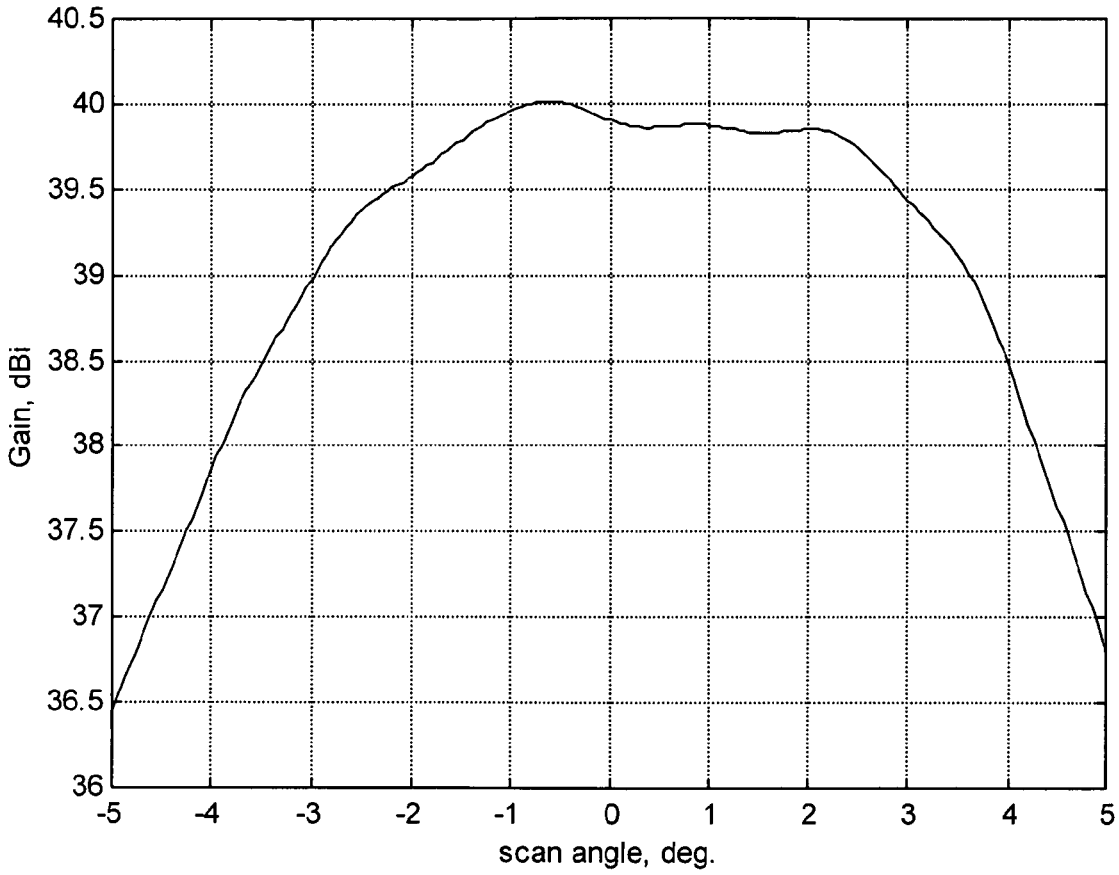
FIG. 8 is a graph showing a gain characteristic curve of a Ka band offset hybrid antenna in accordance with a preferred embodiment of the present invention.

FIG. 8 is a graph showing a gain characteristic curve of a Ka band offset hybrid antenna in accordance with a preferred embodiment of the present invention.

As shown, the Ka band offset hybrid antenna of the present invention has the gain characteristic of minimum 39 dB at ±3° of beam controlling range and maximum 40 dB with 1 dB deviation.

As mentioned above, the present invention can reduce a blocking loss and optimize a beam pattern by shaping a focuser to have a lower aperture and offsetting a feed array.

Also, the present invention can improve a performance by implementing a feed array with a linear active phase and improve efficiency of aperture by providing a focuser having a curvilinear rim.

The present application contains subject matter related to Korean patent application No. KR 2003-0097844, filed in the Korean patent office on Dec. 26, 2003, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. A Ka-band offset hybrid antenna having a shaped focuser, comprising:

a shaped focuser for reflecting a received plane wave to focus an energy of the received plane wave on an offset focal line and reflecting a transmitting signal; and an active feed array module for receiving the reflected received plane wave from the shaped focuser and radiating the transmitting signal to the shaped focuser antenna, wherein the active feed array module including a feed horn array antenna having a plurality of single horns and an active channel block (ACB) having multi-active channels for changing a direction angle of transceiving beam.

2. The Ka-band offset hybrid antenna of claim 1, further comprising:

a power supplying module for supplying direct current of electric power to the active feed array module; and a beam controlling module for controlling a beam direction of the active feed array antenna.

3. The Ka-band offset hybrid antenna of claim 1, wherein the active feed array module includes 8 single horn antennas and 8 active channels and the 8 single horn antennas and 8 active channels are connected respectively in one-to-one manner.

4. The ka-band offset hybrid antenna of claim 3, wherein each of the 8 single horn antennas outputs a radio frequency (RF) signal having unique phase and intensity.

5. The ka-band offset hybrid antenna of claim 3, wherein each of the single horn antennas includes a polarizing flatbed radiation element for feeding an electric power and inducing a polarized wave.

6. The ka-band offset hybrid antenna of claim 3, wherein the single horn has a perfect square waveguide aperture having a size of $0.94\lambda \times 0.94\lambda$.

7. The ka band offset hybrid antenna of claim 1, wherein the shaped focuser has a curvilinear rim structure and lower aperture for optimizing to beam-scan a signal radiated from the active feed array module.

8. The ka band offset hybrid antenna of claim 1, wherein the active feed array module is offset from the shaped focuser.

9. The ka band offset hybrid antenna of claim 8, wherein the shaped focuser has a size of 600 mm×700 mm and the active feed array module is offset from one side of the shaped focuser in a distance of about 192.8 mm and from another side of the shaped focuser in a distance of about 666.1 mm.

* * * * *